United States Patent [19]

Marquis

[11] Patent Number: 4,846,395

[45] Date of Patent: Jul. 11, 1989

[54] CARRYING HANDLE FOR A CARTON

[75] Inventor: Harold L. Marquis, Atlanta, Ga.

[73] Assignee: The Mead Corporation, Dayton, Ohio

[21] Appl. No.: 260,562

[22] Filed: Oct. 21, 1988

[51] Int. Cl.[4] ..... B65D 5/46

[52] U.S. Cl. ..... 229/52 B; 206/141; 206/427

[58] Field of Search ..... 229/40, 52 B; 206/141, 206/427, 434

[56] References Cited

U.S. PATENT DOCUMENTS

| | | | |
|---|---|---|---|
| 2,465,324 | 3/1949 | DeMian | 229/52 B |
| 2,851,210 | 9/1958 | Kramer et al. | 206/141 |
| 3,809,310 | 5/1974 | Vanderlugt, Jr. | 229/52 B |
| 4,364,509 | 12/1982 | Holley, Jr. et al. | 229/52 B |
| 4,588,084 | 5/1986 | Holley, Jr. | 206/427 |
| 4,679,726 | 7/1987 | Olift | 206/427 |
| 4,681,252 | 7/1987 | Doerr et al. | 229/52 B |

*Primary Examiner*—Gary Elkins

*Attorney, Agent, or Firm*—Rodgers & Rodgers

[57] ABSTRACT

A carrying handle for a carton having interconnected top, bottom, side and end walls, one of the walls comprising a pair of overlapping lap panels, a first pair of handle flaps struck from and foldably joined to one of the lap panels, and a second pair of handle flaps struck from and foldably joined to the other lap panel.

10 Claims, 2 Drawing Sheets

CARRYING HANDLE FOR A CARTON

TECHNICAL FIELD

This invention relates generally to cartons used in the packaging of cans and more particularly to the carrying handles for such cartons.

BACKGROUND ART

U.S. Pat. Nos. 4,558,816 and 4,653,686, owned by the assignee of this invention, disclose can cartons in which handle panels are struck from a unitary carton wall.

DISCLOSURE OF THE INVENTION

According to this invention in one form, a carrying handle for a carton comprises interconnected carton top, bottom, side and end walls, one of the walls comprising a pair of overlapped lap panels, a first handle flap foldably joined to one lap panel, and a second handle flap foldably joined to the other lap panel and disposed in alignment with the first handle flap.

BEST MODE OF CARRYING OUT THE INVENTION

Figure 1:
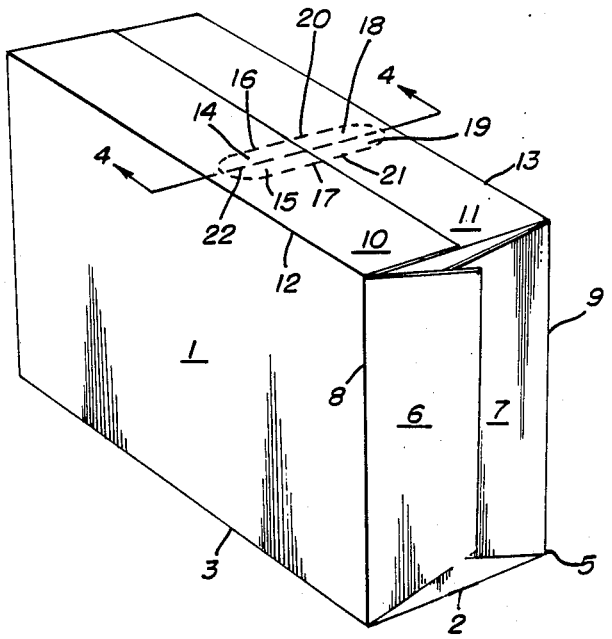
FIG. 1 is a perspective view of a set up carton formed according to this invention.

With particular reference to FIG. 1, the carton comprises side wall 1 which is foldably joined to bottom wall 2 along fold line 3. Bottom wall 2 is foldably joined to side wall 4, identified in FIG. 2, along fold line 5. One end wall of the carton is formed by means of end closure panels 6 and 7 which are foldably joined, respectively, to side walls 1 and 4 along fold lines 8 and 9. The opposite end wall is not observable in the drawings but comprises identical structure to that shown in connection with end closure panels 6 and 7.

The top wall of the carton is formed by means of overlapped lap panels 10 and 11 which are foldably joined, respectively, to the upper edges of side walls 1 and 4 along fold lines 12 and 13.

According to this invention in one form, handle structure is formed in the top wall of the carton in the form of handle flaps 14 and 15 which are foldably joined, respectively, to lap panel 10 along fold lines 16 and 17. Also, handle flaps 18 and 19 are foldably joined, respectively, to lap panel 11 along fold lines 20 and 21. To complete the handle structure, perforated transverse slit 22 extends across a portion of the carton top wall. Perforated transverse slit 22 can be extended transversely of the carton top to fold lines 12 and 13 and, if desired, a relatively short distance into side walls 1 and 4.

Figure 2:
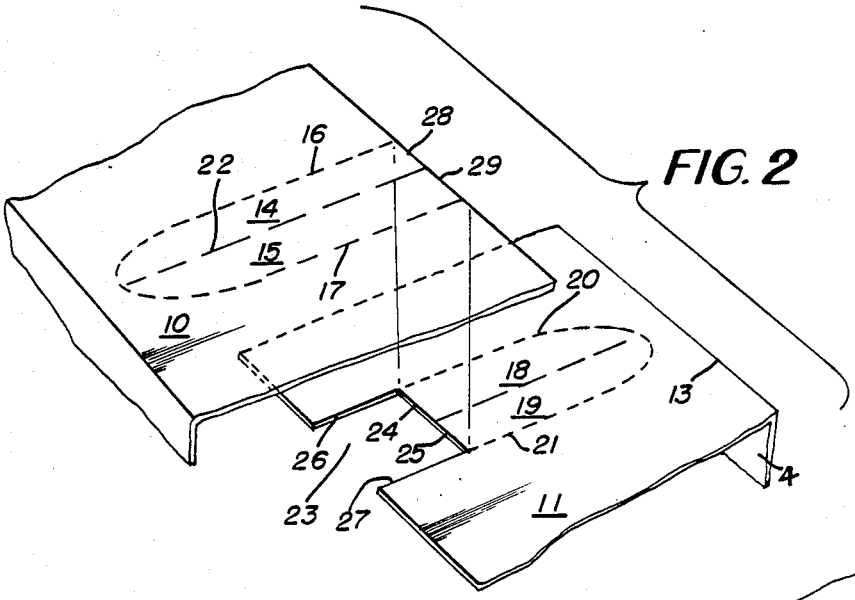
FIG. 2 is an enlarged exploded view showing the handle portion of the carton.
Figure 3:
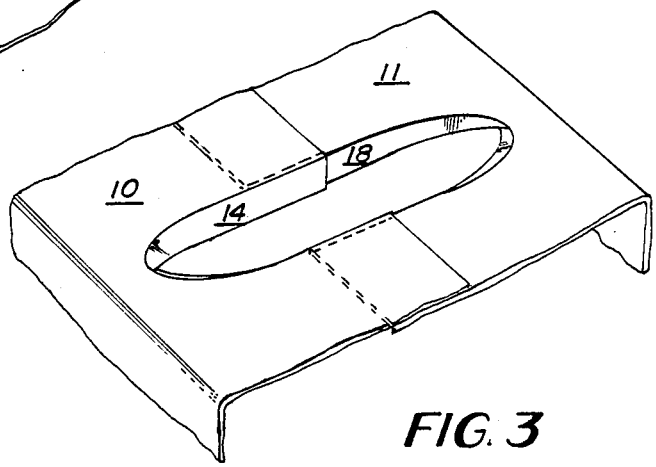
FIG. 3 is an enlarged fragmentary perspective view of the carton handle.
Figure 4:
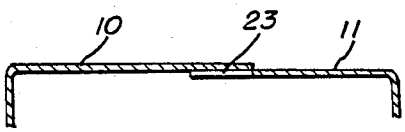
FIG. 4 is a sectional view taken along the line 4—4 in FIG. 1.

According to a feature of this invention, underlying lap panel 11 includes cutaway portion 23 which is bounded by inner ends 24 and 25, respectively, of handle flaps 18 and 19 and by transverse edges 26 and 27 of lap panel 11 which are parallel with perforated transverse slit 22. Therefore, when the carton is formed, inner ends 28 and 29 respectively, of handle flaps 14 and 15 are brought into an adjacent relationship with inner ends 24 and 25, respectively, of handle flaps 18 and 19. This structural relationship is best shown in FIGS. 2 and 4. Without cutaway portion 23, handle flaps 14 and 15 would overlap, respectively, handle flaps 18 and 19 in the overlapped portions of lap panels 10 and 11 in the completed carton thereby causing a binding of multiple layers of paperboard material when the handle flaps are opened to the operating positions shown in FIG. 3.

Figure 5:
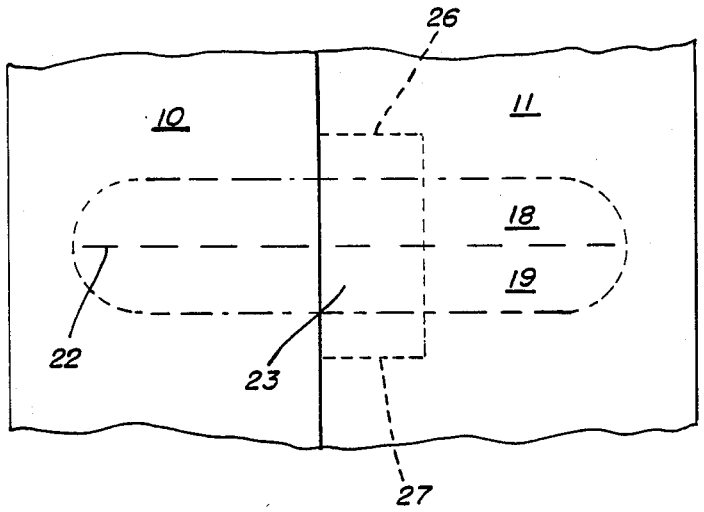
FIG. 5 is an enlarged view of the carton handle as viewed from underneath the top wall.

An alternate form of this invention is shown in detail in FIG. 5 and essentially includes the feature whereby cutaway portion 23 is extended longitudinally of the carton into adjoining portions of lap panel 11. In effect, this causes cutaway portion 23 to be longer than the width of handle flaps 18 and 19.

In operation, when it is desired to transport the carton, the user's fingers are simply slipped into the handle whereby handle flaps 14, 15, 18 and 19 are folded downwardly into generally vertical positions and the carton is transported in the normal manner. The expansion of cutaway portion 23, as shown in FIG. 5, eliminates a double thickness of paperboard material adjacent transverse edges 26 and 27 with the result that the handle flaps are more easily maneuvered into the carrying position without engaging the transverse edges 26 and 27 and any undesirable binding of the paperboard material is virtually eliminated.

For the purpose of understanding another form of carton handle structure formed according to this invention, reference may be had to FIGS. 1–5 wherein handle flaps 14 and 18 are foldably joined, respectively, to lap panels 10 and 11 along fold lines 16 and 20 with elements 17 and 21 comprising perforated transverse slits. Likewise, the handle is also operable wherein handle flaps 15 and 19 are foldably joined, respectively, to lap panels 10 and 11 along fold lines 17 and 21 and elements 16 and 20 form perforated transverse slits. In this version of the invention, element 22 is either incorporated into the handle structure as a fold line or can be omitted altogether. In operation, the handle is essentially manipulated in the same manner as that discussed in connection with FIGS. 1–6.

Figure 6:
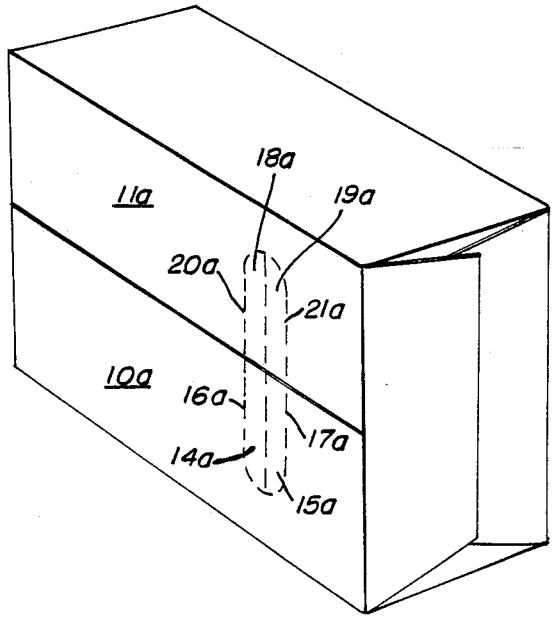
FIG. 6 is a perspective view similar to FIG. 1 and showing a modified form of the invention.

A modified version of this invention is shown in FIG. 6 wherein, instead of the overlapped panels forming the carton top wall, they form the carton side wall. More specifically overlapped lap panels **10*a* and 11*a* form the side wall of the carton and handle flaps 14*a* and 15*a* are foldably joined, respectively, to lap panel 10*a* along fold lines 16*a* and 17*a*. Similarly, handle flaps 18*a* and 19*a* are foldably joined, respectively, to lap panel 11*a* along fold lines 20*a* and 21*a***.

INDUSTRIAL APPLICABILITY

By this invention, the formation of the carton handle in the overlapped lap panels or manufacturing joint of the carton acts to increase overall carton strength in the area of the handle. Since the handle, in essence, comprises four handle flaps, opening of the handle is greatly facilitated. In addition, the glued manufacturing joint adjoining the handle absorbs stress when the carton is transported.

I claim:

1. A carrying handle for a carton formed from a unitary blank for packaging a plurality of cans and having interconnected top, bottom, side and end walls, one of said walls comprising a pair of overlapped lap panels, said handle comprising a first transverse handle flap foldably joined to one of said lap panels, a second transverse handle flap foldably joined to the other of said lap panels and disposed in alignment with said first handle flap, and a perforated transverse slit defining a transverse edge of said first and second handle flaps.

2. A carrying handle according to claim 1 wherein said first handle flap comprises a pair of handle flaps, said second handle flap comprises another pair of handle flaps, said perforated transverse slit comprises coincidental transverse edges of said first and second pairs of handle flaps, and said handle flaps have inner ends disposed in an adjacent relationship with each other.

3. A carrying handle according to claim 2 wherein the underlying one of said lap panels includes a cutaway portion having a longitudinal dimension defined by a pair of transverse edges at least one of which is spaced from and parallel with said perforated transverse slit.

4. A carrying handle according to claim 3 wherein the distance between said transverse edges is greater than the width of one of said pairs of handle flaps.

5. A carrying handle according to claim 3 wherein said cutaway portion is of quadrilateral configuration having a transverse dimension which is approximately equal to the transverse dimension of the overlapped portion of said lap panels.

6. A carrying handle for a carton formed from a unitary blank for packaging a plurality of cans and having interconnected top, bottom, side and end walls, one of said walls comprising a pair of overlapped lap panels, said handle comprising a first pair of transverse handle flaps foldably joined to one of said lap panels, a second pair of transverse handle flaps foldably joined to the other of said lap panels and disposed in alignment with said first pair of handle flaps, and a perforated transverse slit defining coincidental transverse edges of said first and second pairs of handle flaps.

7. A carrying handle according to claim 6 wherein said handle flaps have inner ends disposed in an adjacent relationship with each other.

8. A carrying handle according to claim 6 wherein the length of said first pair of handle flaps and said second pair of handle flaps is less than the width of said one wall.

9. A carrying handle according to claim 6 wherein the underlying one of said lap panels includes a cutaway portion having a longitudinal dimension defined by a pair of transverse edges spaced from and parallel with said perforated transverse slit.

10. A carrying handle according to claim 9 wherein the distance between said transverse edges is greater than the width of one of said pairs of handle flaps.

* * * * *